US008265324B2

(12) United States Patent
Duarte et al.

(10) Patent No.: US 8,265,324 B2
(45) Date of Patent: Sep. 11, 2012

(54) STEREO HEADSET WITH INTEGRATED EARPIECE MOUNT

(75) Inventors: Matias Duarte, Los Angeles, CA (US); Harout Mkhitarian, Altadena, CA (US); Chan Hans Liu, Rosemead City, CA (US); Mun Gwen Chong, Hacienda Heights, CA (US)

(73) Assignee: Virgin Mobile USA, LLC, Warren, NJ (US)

( * ) Notice: Subject to any disclaimer, the term of this patent is extended or adjusted under 35 U.S.C. 154(b) by 1375 days.

(21) Appl. No.: 11/698,613

(22) Filed: Jan. 26, 2007

(65) Prior Publication Data

US 2008/0181423 A1 Jul. 31, 2008

(51) Int. Cl.
*H04R 25/00* (2006.01)

(52) U.S. Cl. ..... 381/374; 381/309; 381/370; 455/569.1

(58) Field of Classification Search ..... 381/74, 381/309, 370, 374, 375, 380; 455/569.1
See application file for complete search history.

(56) References Cited

U.S. PATENT DOCUMENTS

| | | | | |
|---|---|---|---|---|
| 6,374,126 | B1 * | 4/2002 | MacDonald et al. | 455/569.1 |
| 6,519,475 | B1 | 2/2003 | Kim | |
| 6,985,592 | B1 | 1/2006 | Ban et al. | |
| 7,086,512 | B2 | 8/2006 | Shack et al. | |
| 2005/0163337 | A1 * | 7/2005 | Ruegg | 381/370 |

OTHER PUBLICATIONS

U.S. Appl. No. 29/271,804, filed Jan. 26, 2007, Duarte et al.
U.S. Appl. No. 29/271,774, filed Jan. 26, 2007, Duarte et al.
Nokia HDD-1 Stereo Headphones Description—MobilePlanet, p. 1 http://www.mobileplanet.com/d.aspx?i=102693, Mar. 22, 2002.

* cited by examiner

*Primary Examiner* — Vivian Chin
*Assistant Examiner* — Paul Kim

(57) ABSTRACT

An improved monaural and stereophonic headset is provided that allows subscribers to safely stow away an unused earpiece. The headset includes a connector that is constructed in a manner such that it is capable of directly interfacing with and retaining an ear plug. In another aspect of the invention, an ear plug is provided that is adapted to be received by the connector in the monaural and stereophonic headset.

17 Claims, 4 Drawing Sheets

STEREO HEADSET WITH INTEGRATED EARPIECE MOUNT

FIELD OF THE INVENTION

The present invention relates generally to monaural and stereophonic headsets, and more particularly to hands-free headsets for electronic devices.

BACKGROUND OF THE INVENTION

Modern mobile electronic devices that incorporate wireless voice communications capability are designed to give users maximum freedom of movement while using the device. Towards this goal, mobile electronic devices are often equipped with hands-free headsets that allow subscribers to make or answer calls without requiring the use of their hands. In many instances, modern mobile electronic devices also feature stereophonic playback of audio such as stored music, radio or recorded conversations. Accordingly, these headsets have been developed to accommodate stereo listening as well as monaural conversation. Typically, such headsets include two earpieces and a microphone that are attached to the device via a connector and electrical cords. When the mobile electronic device is operated in the stereo listening mode, both earpieces are necessary. In the monaural conversation mode, only one of the earpieces and the microphone is required.

However, switching between stereo listening mode and monaural conversation mode can be relatively cumbersome. For example, a subscriber who is listening to music in the stereo listening configuration, may desire to make a call and switch to the monaural conversation mode. In this configuration, the subscriber requires only one earpiece and the microphone. The unused earpiece is left to hang by the cord from the connector. A dangling earpiece poses several hazards. The cord may become tangled or looped around other devices in the vicinity. A dangling earpiece can be particularly irksome in an automobile. The cord may catch on protrusions and tear the electronic device out of a holding dock or the subscriber's pocket. In other instances, the earpiece may be jerked out of the subscriber's ear. As a result, a subscriber who is operating an automobile may be distracted. Also, many times a subscriber may lose or damage an earpiece because there is no proper storage for it while not in use.

SUMMARY OF THE INVENTION

Thus, a need exists for an improved monaural and stereophonic headset that allows subscribers to safely stow away an unused earpiece.

In satisfaction of this need, the present invention relates to a headset which can be used with both monaural and stereophonic input.

In accordance with one aspect of the present invention, a connector is provided for use in a monaural or stereophonic headset. The connector includes an input port for an input cord and a first and second output port for cords connected to a first ear plug and a microphone. The microphone is further connected to a second ear plug. The connector is constructed such that it is capable of directly interfacing with and retaining an ear plug.

In one embodiment of the present invention, the connector further includes a housing and a yoke. The yoke is flushly mounted to a top portion of the housing. In another embodiment, the housing includes a V-shaped channel and an indentation forming an extension of the V-shaped channel formed on a surface of the housing. The V-shaped channel is further adapted to receive an earpiece junction.

In yet another embodiment, the yoke includes a first and second prong each surrounding a portion of the first and second cord connected to the ear plug and the microphone. The yoke further includes a U-shaped receptacle disposed between the first and second prong. The U-shaped receptacle is adapted to receive an ear plug.

Another aspect of the present invention relates to an ear plug adapted to be received by a connector in a monaural or stereophonic headset. The ear plug includes an earpiece, an earpiece junction surrounding a cord and a neck joining the earpiece and the earpiece junction. The neck of the ear plug is shaped such that it directly interfaces with a receptacle formed on a surface of the connector.

In an embodiment of the present invention, the neck is further shaped so as to directly interface with a U-shaped receptacle formed on the surface of the connector. In another embodiment, the earpiece junction is adapted to be received within the V-shaped channel formed on the surface of the connector.

In accordance with yet another aspect of the present invention, a stereophonic headset is provided. The headset includes a connector, a first and second ear plug, and cords connecting the first and second ear plugs to the connector. The connector is constructed such that it is capable of directly interfacing with and retaining the first ear plug so as to minimize physical size.

BRIEF DESCRIPTION OF THE DRAWINGS

These embodiments and other aspects of this invention will be readily apparent from the detailed description below and the appended drawings, which are meant to illustrate and not to limit the invention, and in which.

DETAILED DESCRIPTION OF THE PREFERRED EMBODIMENTS

The present invention will be more completely understood through the following detailed description, which should be read in conjunction with the attached drawings. In this description, like numbers refer to similar elements within various embodiments of the present invention. Within this detailed description, the claimed invention will be explained with respect to preferred embodiments. However, the skilled artisan will readily appreciate that the methods and systems described herein are merely exemplary and that variations can be made without departing from the spirit and scope of the invention.

In general, embodiments of the present invention provide an improved monaural or stereophonic headset that allows users to safely stow away an earpiece when not in use. This is achieved through the use of a receptacle located on a connector attached to a cable connecting the earpiece to a mobile electronic device.

Figure 1:
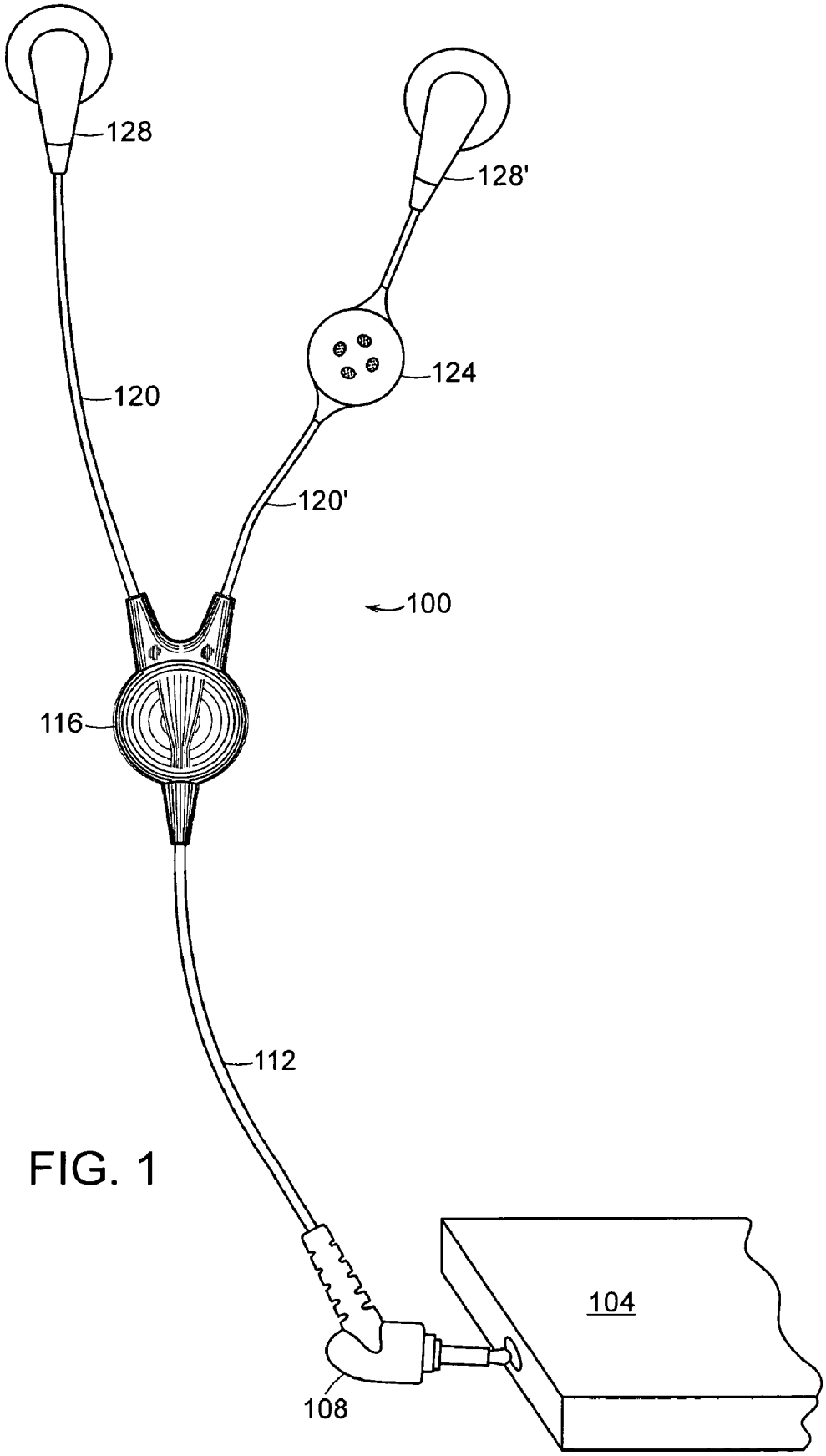
FIG. 1 depicts a monaural or stereophonic headset in accordance with an embodiment of the present invention.

FIG. 1 depicts a monaural or stereophonic headset in accordance with an embodiment of the present invention. As illustrated, the monaural or stereophonic headset 100 is connected to a mobile electronic device 104. The headset 100 includes a plug 108, a first cord 112, a connector 116, a pair of cords 120, 120', a microphone 124, and a pair of ear plugs 128, 128'.

The mobile electronic device 104 may be a device that incorporates a stereo music output which can include a radio, a compact disk, tape, DVD, or other audio listening source as well as one or more of a pager, a cellular phone, a personal digital assistant ("PDA"), a digital multimedia broadcasting ("DMB") phone, a smart phone, or the portable terminal disclosed in commonly assigned patent application Ser. No. 11/409,893, filed Apr. 24, 2006, entitled "HINGE MODULE FOR THREE-STEP OPEN TYPE PORTABLE TERMINAL AND PORTABLE TERMINAL HAVING THE SAME," hereby incorporated herein by reference.

The plug 108 provides a detachable connection between the headset 100 and the mobile electronic device 104. The plug 108 may consist of any suitable plug and socket arrangement, depending on the requirements of the mobile electronic device 104 to which the headset 100 is adapted. The first cord 112 provides the electrical connection from the mobile electronic device 104 to the connector 116. The pair of cords 120, 120' connects the pair of ear plugs 128, 128' and the microphone 124.

An ordinary person skilled in the art will readily recognize that various microphone 124 constructions may be integrated into the headset 100. For example, the microphone 124 may be a two-face convex circular construction sensitive to audio signals. As shown in FIG. 1, the microphone 124 may be integrated into the headset 100 between the connector 116 and an ear plug 120'. In other embodiments, the microphone 124 may be fixed to an end of a separate adjustable collar.

Figure 2C:
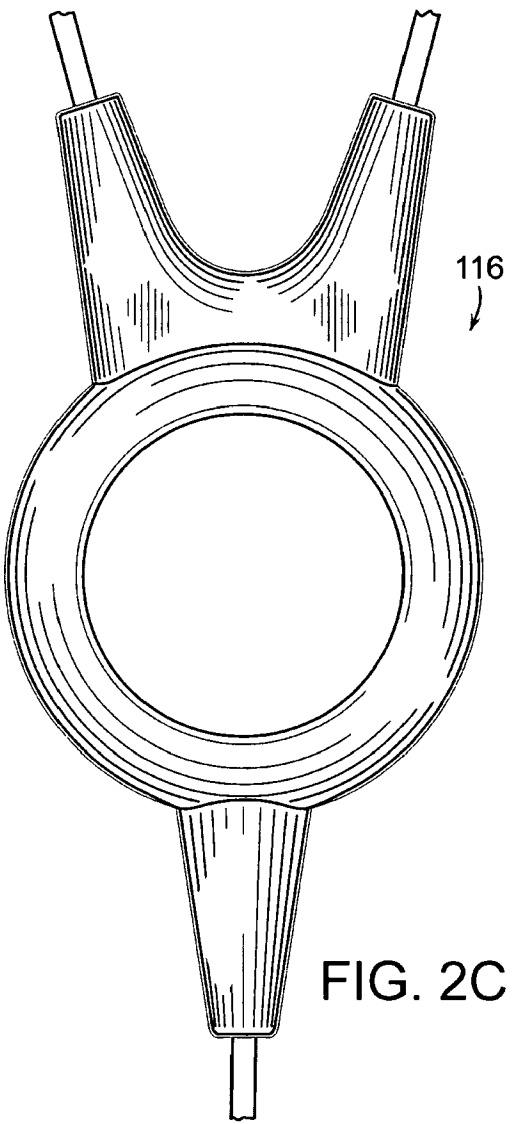
FIGS. 2A, 2B and 2C are enlarged rear, side and front views of a connector for use in a monaural or stereophonic headset.
Figure 2B:
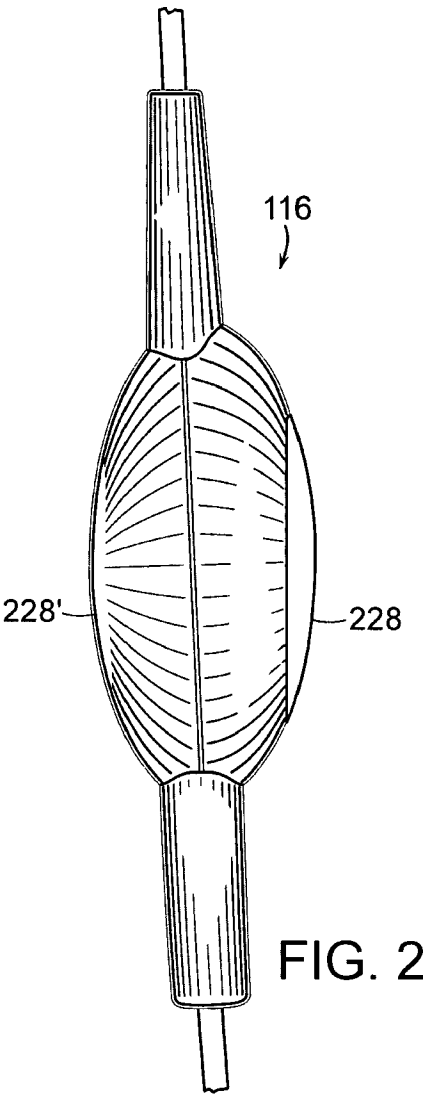
Figure 2A:
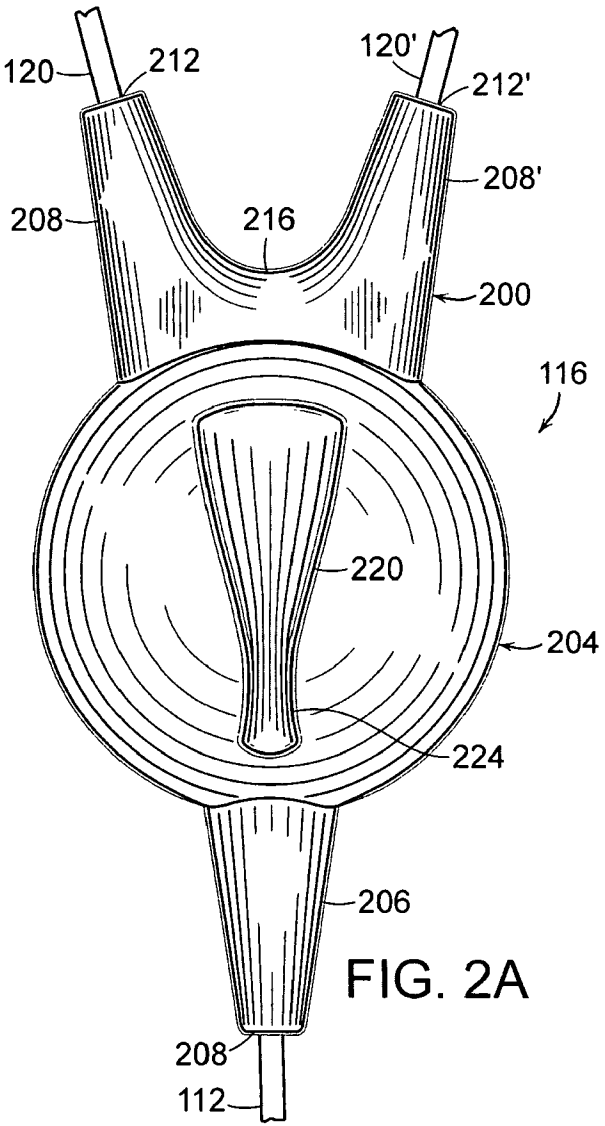

FIGS. 2A, 2B and 2C are enlarged rear, side and front views of the connector 116 for use in a monaural or stereophonic headset 100. The connector 116 includes a yoke 200, a housing 204, an input prong 206 and an input port 208 for the first cord 112. The yoke 200 is mounted on top of the housing 204. In an embodiment of the present invention, the yoke 200 is mounted such that it is in direct contact with the housing 204. In another embodiment of the present invention, the housing 204 is constructed such that it is substantially circular. As shown in FIG. 2B, the housing 204 includes a front and back portion 228, 228' each having a substantially convex profile.

Referring now to FIG. 2A, the input prong 206 surrounds a portion of the first cord 112. The input port 208 is located at the end of the input prong 206. In another embodiment of the present invention, the input port 208 may be located directly on a surface of the housing 204.

The yoke 200 further includes two prongs 208, 208', two output ports 212, 212' for the pair of cords 120, 120' and a U-shaped receptacle 216 located centrally between the two prongs 208, 208'. The prongs 208, 208' are formed as two upwardly projecting leg portions extending in a direction away from each other. Each prong 208, 208' is adapted to surround a portion of each of the pair of cords 120, 120'. The output ports 212, 212' for the pair of cords 120, 120' are located on the top of each prong 208, 208'.

The U-shaped receptacle 216 is formed within the thickness of the yoke 200. The height of the U-shaped receptacle 216 is a substantial fraction of the height of the yoke 200. The prongs 208, 208' form the upwardly projecting leg portions of the U-shaped receptacle 216. In an embodiment of the present invention, the dimensions and shape of the U-shaped receptacle 216 are such that it is capable of receiving and retaining one of the pair of ear plugs 128,128'.

The housing 204 further includes a V-shaped channel 220 and an indentation 224 forming an extension to the V-shaped channel 220. The V-shaped channel 220 and the indentation 224 are adapted to receive a portion of one of the pair of ear plugs 128, 128' and connecting cords 120, 120'.

Figure 3C:
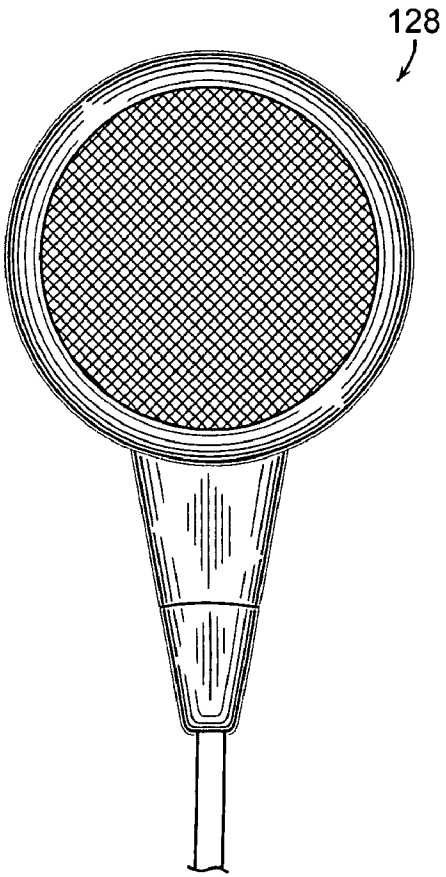
FIGS. 3A, 3B and 3C are enlarged rear, side and front views of an ear plug for use in a monaural or stereophonic headset.
Figure 3B:
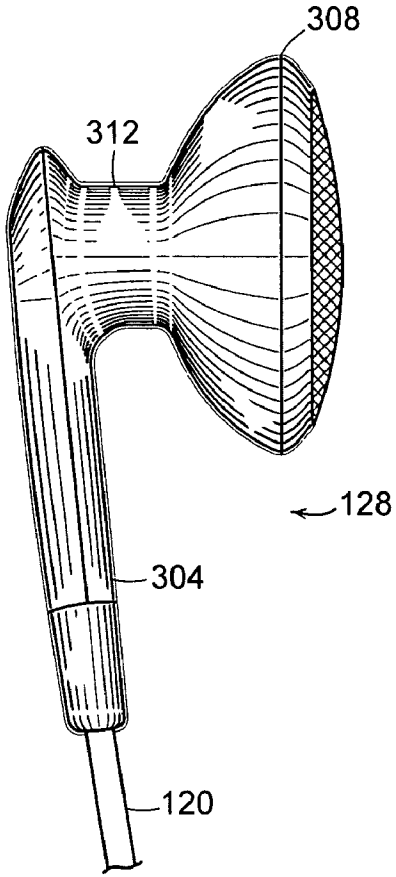
Figure 3A:
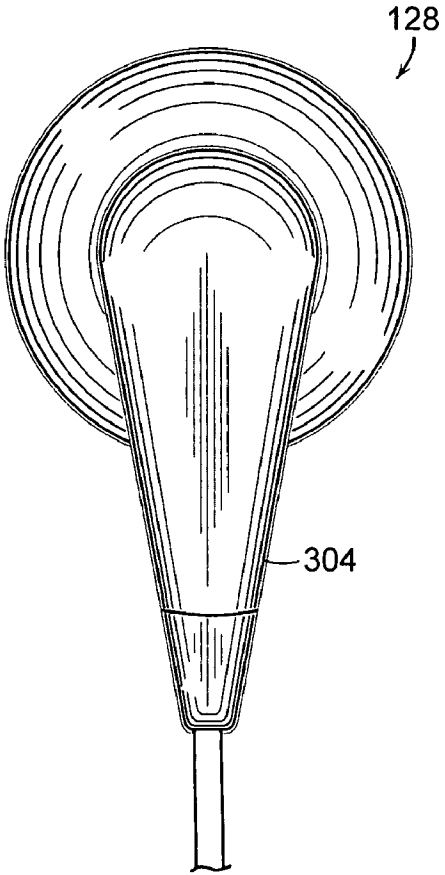

FIGS. 3A, 3B and 3C are enlarged rear, side and front views of an ear plug 128, 128' (Generally, 128) for use in a monaural or stereophonic headset 100. As shown, the ear plug 128 includes an earpiece junction 304, one of the pair of cords 120, 120' (Generally 120), an earpiece 308 and a neck 312. The earpiece junction 304 is shaped to be received within the V-shaped channel 220. The earpiece junction 304 is further configured to surround and hold a portion of the cord 120.

The earpiece 308 includes a miniature speaker and is adapted to sit in the ear of a user. The earpiece 308 may be a single piece or multiple piece molded construction. In alternate embodiments of the present invention, the earpiece 308 may be accompanied by an over-the-ear ("OTE") or behind-the-ear ("BTE") headset support structure configuration.

The neck 312 joins the earpiece 308 with the earpiece junction 304. The neck 312 is shaped such that it is received and retained within the U-shaped receptacle 216. In an embodiment of the present invention, the neck 312 is shaped and dimensioned in such a manner that the ear plug 128 is retained snugly in position and resists movement within the U-shaped receptacle 216.

Figure 4C:
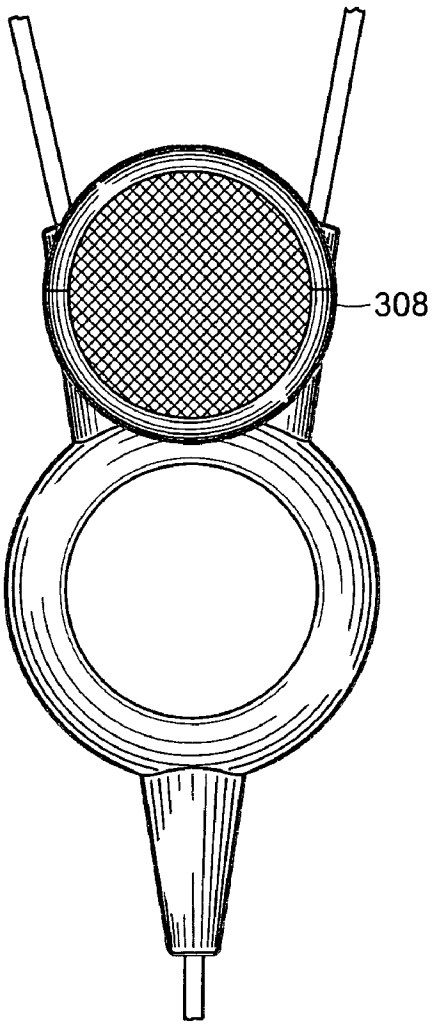
FIGS. 4A, 4B and 4C depict enlarged rear, side and front views of an unused ear plug mounted on the connector in accordance with an embodiment of the present invention.
Figure 4B:
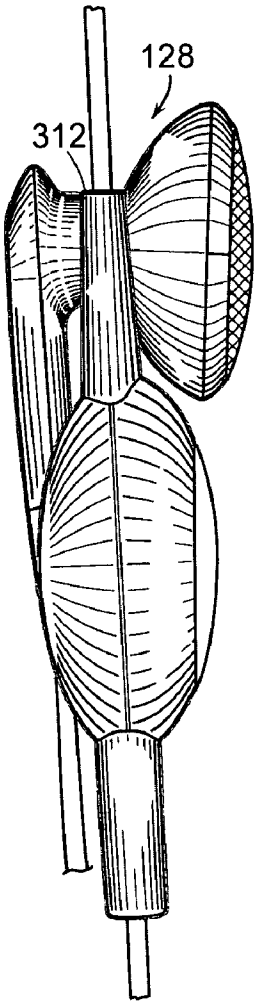
Figure 4A:
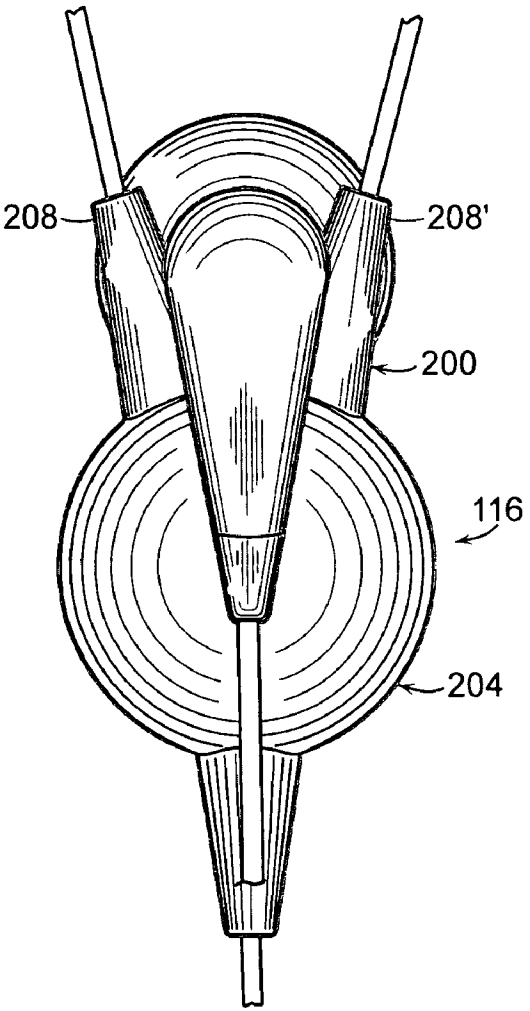

FIGS. 4A, 4B and 4C depict enlarged rear, side and front views of an unused ear plug 128 mounted on the connector 116 in accordance with an embodiment of the present invention. As shown, the neck 312 of the ear plug 128 is received and retained within the U-shaped receptacle 216 formed on the surface of the yoke 200.

In an embodiment of the present invention, the U-shaped receptacle 216, the earpiece 308 and the neck 312 are further configured to reduce the size, protrusion or extension of the ear plug 128 when it is mounted on the connector 116. As a result, the ear plug 128 and the connector 116 interface in a space-efficient fashion. Accordingly, in another embodiment of the present invention, the height of the yoke 200 is such that the top surface of the prongs 208, 208' are at a substantially higher level relative to the top surface of the neck 312. In yet another embodiment of the present invention, the bottom of the U-shaped receptacle 216 is formed as close as possible to the top surface of the housing 204. Consequently, as shown in FIG. 4C, a portion of the earpiece 308 overlaps the housing 204, minimizing physical size.

An ordinary artisan skilled in the art will readily recognize that the invention is not limited to the shapes and sizes disclosed. Ear plugs 128 of other shapes and sizes, as well as a different shape and size of the associated receptacle 216 formed on the surface of the connector 116 may be possible.

Optionally, the headset 100 may be configured such that the ear plug 128' and microphone 124 are activated when a user wishes to switch from stereo listening mode to monaural conversation mode. In operation, the user may then remove the unused ear plug 128 and conveniently mount it in the U-shaped receptacle formed on the connector 116 for this purpose. After the ear plug 128 is safely stowed away, the user may proceed to make or answer a call. In another possible operation of the claimed invention, the user may need to switch intermittently between music listening and monaural conversation mode. Consequently, he or she may decide to temporarily not use the second ear plug 128. In such a situation, the unused ear plug 128 may remain securely mounted on the connector 116.

Variations, modification, and other implementations of what is described herein will occur to those of ordinary skill in the art without departing from the spirit and scope of the invention as claimed. Accordingly, the invention is to be defined not by the preceding illustrative description but instead by the spirit and scope of the following claims.

What is claimed is:

1. A connector for use in a monaural or stereophonic headset, the connector comprising:

an input port for a first cord;

a first output port for a second cord;

a second output port for a third cord; and a housing comprising:

a V-shaped channel formed on a surface of the housing, the V-shaped channel adapted to receive a junction of a first ear plug, the first ear plug connected to the connector through the second cord; and an indentation formed on the surface of the housing to receive a portion of the second cord, the indentation forming an extension of the V-shaped channel;

wherein the connector is constructed such that it is capable of directly interfacing with and retaining the first ear plug in the housing, the connector connected to a second ear plug through the third cord.

2. The connector of claim 1, wherein a microphone is connected between the third cord and the second ear plug.

3. The connector of claim 1, wherein the first and second output ports are located on the upper surface of the connector.

4. The connector of claim 1, further comprising:

a yoke flushly mounted to a top portion of the housing.

5. The connector of claim 4 wherein the yoke comprises a first prong surrounding a portion of the first cord.

6. The connector of claim 1, wherein the housing is substantially circular.

7. The connector of claim 1 wherein the housing has a front portion and a back portion, each having a substantially convex profile.

8. The connector of claim 5, wherein the yoke further comprises a second prong surrounding a portion of the second cord.

9. The connector of claim 8, wherein the yoke further comprises a U-shaped receptacle disposed between the first and second prong, the U-shaped receptacle adapted to receive an ear plug.

10. The connector of claim 9, wherein the V-shaped channel is centered with respect to the first and second prong, and is located below the U-shaped receptacle of the yoke.

11. An ear plug assembly comprising:

an earpiece;

a cord coupled to the earpiece;

an earpiece junction surrounding the cord; and a neck joining the earpiece and the earpiece junction;

wherein the neck is shaped so as to directly interface with a receptacle formed on a surface of a connector, the connector separated from the ear plug by the cord, the connector including a housing comprising:

a V-shaped channel formed on a surface of the housing, the V-shaped channel adapted to receive the earpiece junction; and an indentation formed on the surface of the housing to receive a portion of the cord, the indentation forming an extension of the V-shaped channel.

12. The ear plug assembly of claim 11, wherein the neck is further shaped so as to directly interface with a U-shaped receptacle formed on a surface of the connector.

13. A stereophonic headset comprising:

a connector;

a microphone connected to the connector via a first cord;

a first ear plug connected to the microphone via a second cord;

wherein the connector is constructed such that it is capable of directly interfacing with and retaining the first ear plug, the connector including a housing comprising:

a V-shaped channel formed on a surface of the housing, the V-shaped channel adapted to receive a junction of the first ear plug; and an indentation formed on the surface of the housing to receive a portion of the second cord, the indentation forming an extension of the V-shaped channel.

14. The stereophonic headset of claim 13, further comprising a second ear plug connected to the connector via a third cord.

15. The stereophonic headset of claim 14, wherein the connector further comprises:

a yoke flushly mounted to a top portion of the housing.

16. The stereophonic headset of claim 13, wherein the first ear plug further comprises:

an earpiece;

an earpiece junction surrounding a part of the second cord; and a neck joining the earpiece and the earpiece junction;

wherein the neck is shaped so as to directly interface with a receptacle formed on a surface of the connector.

17. The stereophonic headset of claim 13, wherein the ear plug and the connector interface so as to minimize physical size.

* * * * *